US007216769B2

(12) United States Patent
Palder

(10) Patent No.: US 7,216,769 B2
(45) Date of Patent: May 15, 2007

(54) NESTABLE CONTAINERS

(76) Inventor: Saul Palder, 1476 River St., Hyde Park, MA (US) 02136

( * ) Notice: Subject to any disclaimer, the term of this patent is extended or adjusted under 35 U.S.C. 154(b) by 251 days.

(21) Appl. No.: 10/646,581

(22) Filed: Aug. 22, 2003

(65) Prior Publication Data

US 2005/0040068 A1 Feb. 24, 2005

(51) Int. Cl.
*A47F 7/00* (2006.01)

(52) U.S. Cl. ..... 211/49.1

(58) Field of Classification Search ..... 211/78, 211/71.01, 49.1; 206/518, 519, 505; 220/675, 220/671, 793, 23.6, 62.13, 380, 819, 573.1
See application file for complete search history.

(56) References Cited

U.S. PATENT DOCUMENTS

| | | | | |
|---|---|---|---|---|
| 2,823,829 | A | 2/1958 | Frater | |
| 2,873,782 | A | 2/1959 | Gunn | |
| D196,392 | S | 9/1963 | Politis | |
| 3,344,974 | A | 10/1967 | Bostrom | |
| 3,389,851 | A | 6/1968 | Clark | |
| 3,424,342 | A * | 1/1969 | Scopp et al. | 220/793 |
| 3,447,714 | A | 6/1969 | Elliot | |
| 3,448,888 | A | 6/1969 | Smith | |
| 3,460,711 | A | 8/1969 | Al-Roy | |
| 3,739,939 | A * | 6/1973 | Koenig | 206/518 |
| 3,759,416 | A * | 9/1973 | Constantine | 206/505 |
| 3,931,890 | A | 1/1976 | Davis | |
| 4,007,839 | A | 2/1977 | Stahl | |
| 4,235,338 | A | 11/1980 | Dugan et al. | |
| 4,275,815 | A | 6/1981 | Davis | |
| 4,286,713 | A | 9/1981 | Marchais | |
| 4,412,630 | A * | 11/1983 | Daenen | 220/792 |
| 4,416,374 | A | 11/1983 | Smith et al. | |
| 4,593,816 | A | 6/1986 | Langenbeck | |
| 4,700,842 | A | 10/1987 | Grusin | |
| 4,756,425 | A | 7/1988 | Wise | |
| 4,817,801 | A | 4/1989 | Schwaikert | |
| 4,875,620 | A | 10/1989 | Lane, Sr. | |
| 4,877,151 | A | 10/1989 | Rush et al. | |
| 4,919,278 | A * | 4/1990 | Howen | 211/49.1 |
| D317,567 | S | 6/1991 | Lane, Sr. | |
| 5,040,682 | A | 8/1991 | Palisin et al. | |
| 5,160,031 | A | 11/1992 | Palisin, Jr. et al. | |
| 5,204,130 | A | 4/1993 | McDevitt et al. | |

(Continued)

OTHER PUBLICATIONS

International Search Report for related application. Apr. 21, 2005.

(Continued)

*Primary Examiner*—Sarah Purol
(74) *Attorney, Agent, or Firm*—Wolf Greenfield & Sacks

(57) ABSTRACT

A nestable container designed for efficient storage when the containers is not in use and for safe handling when in use. The container has four outwardly bowed sidewalls flared upwardly from its bottom with each sidewall connected to adjacent sidewalls by an inwardly fluted web to form a essentially square cross section. The webs define finger gripping corners at the edges of the sidewalls that allow the container to gripped better by a user. The containers can be nested with other containers of different sizes without wasting space. The essentially square configuration of the containers also make them easy to pack with or within other containers, that are typically also square or rectangular.

27 Claims, 7 Drawing Sheets

U.S. PATENT DOCUMENTS

| | | | | |
|---|---|---|---|---|
| 5,423,453 | A | | 6/1995 | Fritz |
| D364,564 | S | | 11/1995 | Moore |
| 5,634,569 | A | | 6/1997 | DeCoster |
| 5,641,090 | A | * | 6/1997 | Kowalski et al. ..... 220/782 |
| D395,392 | S | | 6/1998 | Lahm et al. |
| 5,829,616 | A | | 11/1998 | Daniel et al. |
| D420,585 | S | | 2/2000 | Guillin |
| D439,839 | S | | 4/2001 | Wolf et al. |
| D473,463 | S | | 4/2003 | Armstrong et al. |
| 6,585,119 | B2 | | 7/2003 | Palder |
| 6,874,650 | B2 | * | 4/2005 | Welsh et al. ..... 220/519 |
| 6,883,678 | B2 | * | 4/2005 | Chou ..... 220/793 |
| 2003/0015530 | A1 | | 1/2003 | Shepler et al. |
| 2003/0094393 | A1 | | 5/2003 | Sahm, III |

OTHER PUBLICATIONS

Written Opinion of International Searching Authority Apr. 21, 2005.

* cited by examiner

NESTABLE CONTAINERS

FIELD OF INVENTION

The present invention relates to a nestable storage container and more particularly to nestable storage containers designed to receive a removable cover.

BACKGROUND OF THE INVENTION

Nestable containers for storing contents are known in the prior art. Generally, such prior art containers are identical to one another to allow them to be nested together. Nesting the containers in such a manner reduces the amount of storage space required to hold the containers when they are not in use. However, the features in the prior art designs that allow the containers to be nested also create problems with the containers. For instance, they often reduce the structural integrity of the container and/or make them more difficult to handle. Additionally, the identical designs of such containers limit them to containers of the same holding capacity. Moreover, many stacking designs must be specifically pre-oriented to permit stacking and are frequently designed to receive covers or lids that are not easy to remove. A common problem as well is the often existing variety of (food) containers stored in kitchen cupboards that are difficult to match up with the fitting lids of any particular container within such an assortment.

SUMMARY OF INVENTION

The containers of the present invention are designed for an efficient overall storage system for open, in cabinet storage when not in use and designed with features for easy, safe handling during use.

In one embodiment, the nestable container has four sidewalls flared upwardly and outwardly from a common bottom. Each sidewall is connected to its adjacent sidewalls by an inwardly fluted web defining finger gripping corners at the edges of said sidewalls.

In another embodiment, the nestable container has four sidewalls flared upwardly and outwardly from a common bottom. Each sidewall is connected to adjacent sidewalls by an inwardly fluted web defining finger gripping corners at the edges of the sidewalls. The upper end of each fluted web is defined by a wall or lip having an edge that is continuous with upper edges of the adjacent sidewalls and defines a continuous edge for engagement with a lid.

In yet another embodiment, each of a series of nestable containers have four sidewalls flared upwardly and outwardly from a common bottom. Each sidewall is connected to its adjacent sidewalls by an inwardly fluted web, defining finger gripping corners at the edges of adjacent sidewalls. The open end of each nestable container is defined by a continuous upper edge adapted to mate with a lid, the upper edge having a periphery greater than the bottom.

Various embodiments of the present invention provide certain advantages and overcome certain drawbacks of prior containers. Embodiments of the invention may not share the same advantages, and those that do may not share them under all circumstances. This being said, the present invention provides numerous advantages including the noted advantages of improved efficiency in storing the containers, and also the improved handling during use.

Further features and advantages of the present invention, as well as the structure of various embodiments, are described in detail below with reference to the accompanying drawings.

BRIEF DESCRIPTION OF DRAWINGS

In the drawings, similar features that are illustrated in various figures are represented by like numerals. For purposes of clarity, not every component may be labeled in every drawing. In the drawings.

DETAILED DESCRIPTION

The containers of the present invention are adapted for efficient stacking when they are not in use, and for safe handling when they are in use and facilitate the easy removal of a lid without the likelihood of spilling any contents of the container.

Figure 1:
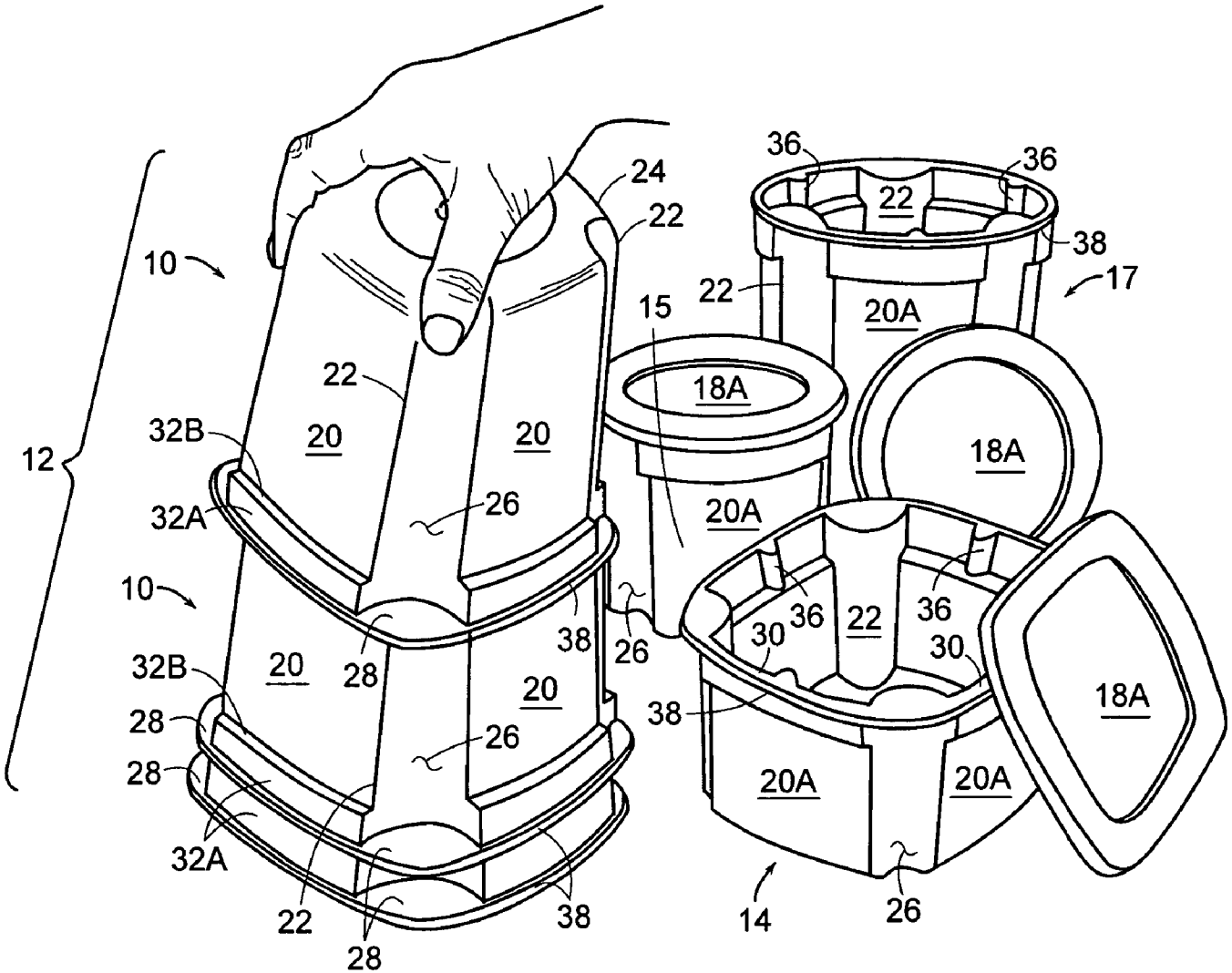
FIG. 1 is a perspective view of embodiments of two different sizes and shapes of nestable containers shown in a stored, nested open and closed configurations, as well as showing the textured flutes relative to finger position in "lift-up" mode.
Figure 2:
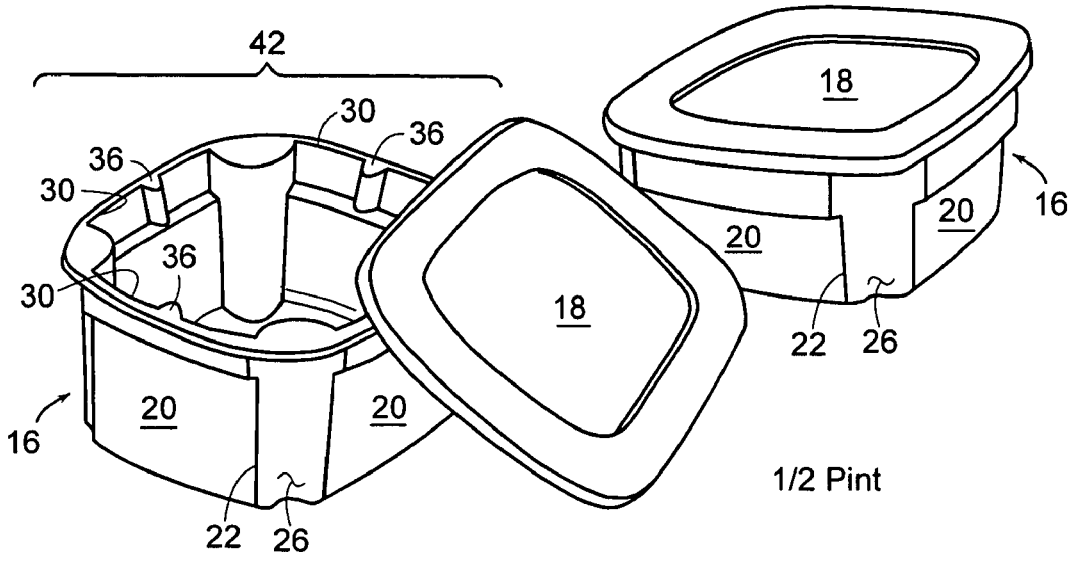
FIG. 2 is a perspective view of an embodiment of a nestable containers with a lid secured to one and adjacent to the other.

Turning to the Figures, and in particular FIGS. 1 and 2 where illustrative embodiments of the nestable containers 10 are shown. Several different sized nestable containers in inverted, stacked and upright configurations are illustrated. The first stack 12 is of nestable containers that are larger in size and may contain a greater volume of contents than the container 14. These containers 10 and 14 may, for example, contain 1 quart and 1 pint, respectively, although they may be sized to contain any other volume, as the present invention is not limited in this respect. FIG. 2 shows a third embodiment of a nestable container that contains a volume different than those shown in FIG. 1, which may, for instance, be ½ pint. This container 16 is shown in a configuration used for storing contents with its lid 18 securely fastened thereto. Also illustrated in FIG. 1 are essentially frusto conic configured containers 15 and 17 that are of different volumes, but each have identically sized and shaped open ends designed to receive circular covers 18A. Regardless of the volume the containers 10 and 14 can hold, they each have a commonly sized top rim 30 at the open end 42, the benefits of which will be described below. The four sided containers illustrated by containers 10 and 14 will require a larger volume of plastic to hold the same volume as containers 15 and 17, but since the four sided container may make more efficient space use of a refrigerator or the like, when stored. The detailed description refers primarily to the four sided container 10 and 14 but the broader advantages and features also apply to containers 15 and 17.

Figure 3:
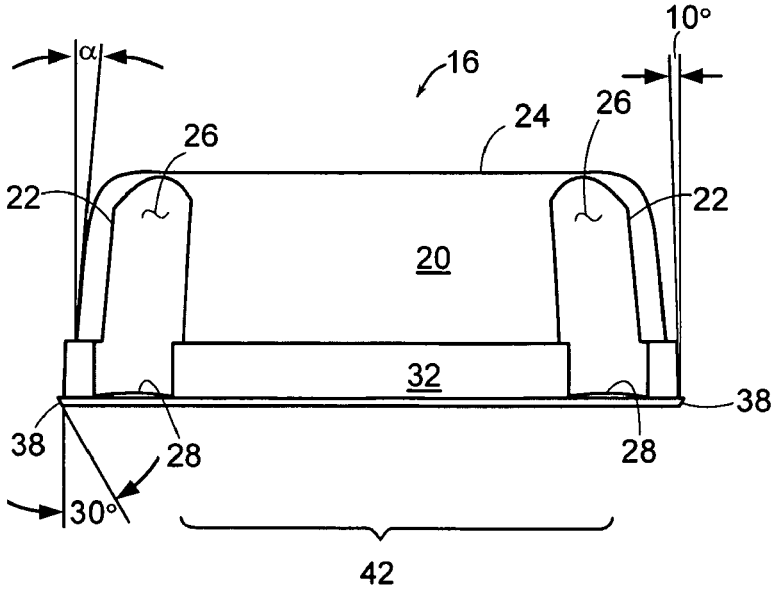
FIG. 3 is an inverted side view of an embodiment of a nestable container.
Figure 5A:
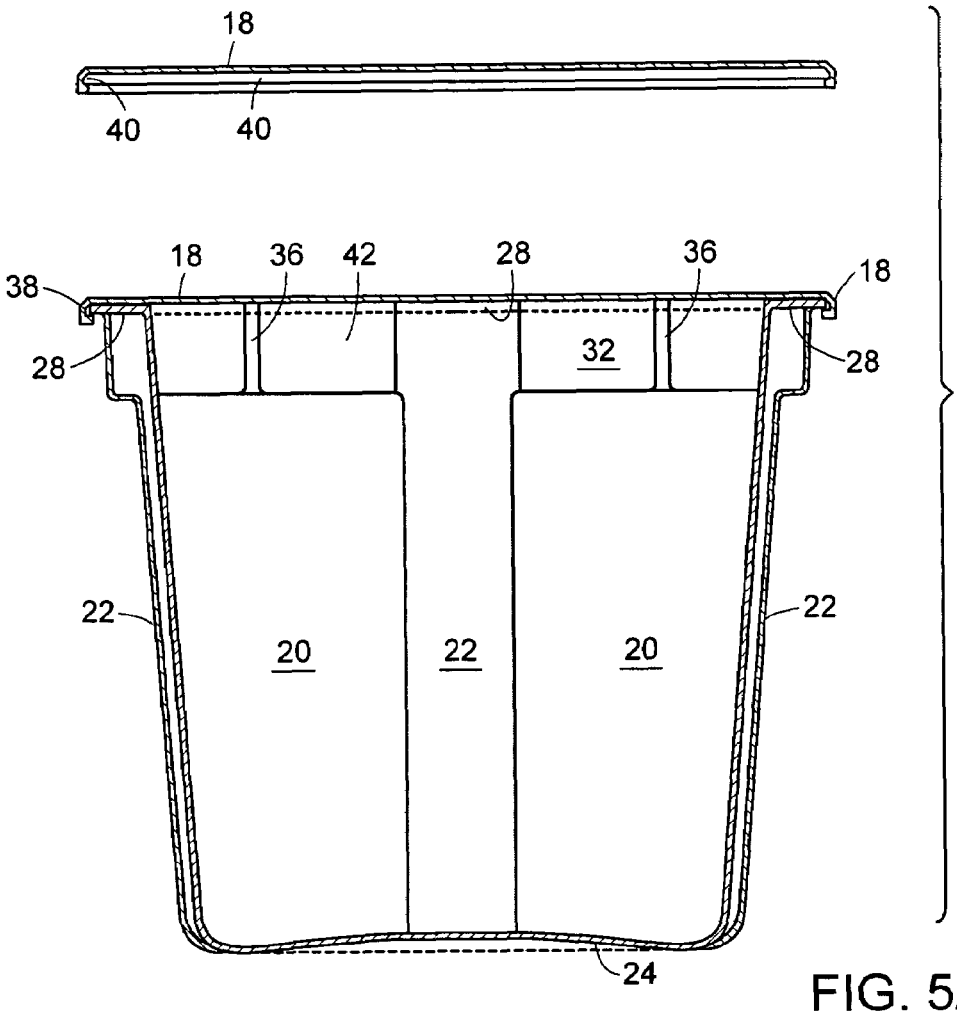
FIG. 5 is a cross-sectional view taken along line 5A-5A shown in FIG. 4 and includes a lid cross section that is not shown in FIG. 4.

Each of the containers 10 and 14 have sidewalls 20 that are angled outwardly from the bottom 24 of the container to the open end 42, preferably at a 5 degree angle as depicted in FIG. 3 by the constant "α". The angling of the sidewalls 20 and the inwardly bowed or fluted gripping portions 22 that are between each adjacent sidewall create a cross section that gradually decreases from top to bottom, along the longitudinal axis of each container. This decreasing cross section allows the containers to fit, almost entirely, within another container of the same size or a larger size. Only the top rim 30 and stepped section 32 comprising an outer wall 32*a* and bottom 32*b* (FIG. 5*a*) of a container in most embodiments will not fit inside of a corresponding nested container. The top rim and stepped section is preferably in the order of about 0.5" to 1", but most preferably in the order of 0.68 inches tall, meaning that each additional stacked container only consumes about an additional corresponding 0.5" to 1.0" of space in the stacking direction of the preferred embodiment. In another embodiment, only the rim provides height that does not nest within the adjacent container. The essentially square configuration allows the containers to be stacked or nested on top of one another in any one of four different rotational orientations, thus eliminating the need to carefully orient the containers before stacking or nesting.

The common top rim 30 and essentially square shape of each container also allows containers of different sizes to be stacked with one another. For example, a two quart container, and one quart container as shown in FIG. 1, and a one pint container as shown in FIGS. 2 and 3 may all be stacked with one another. Although the containers may be stacked with the smaller container inside of the larger container, or vice-versa, it is preferable that the smaller container be placed inside of the larger container. This configuration allows the top rims of each container contacting one another and thus stabilizing the nested stack of containers, as is shown in FIGS. 1, 2, and 6A and as is described in greater detail below.

Figure 4:
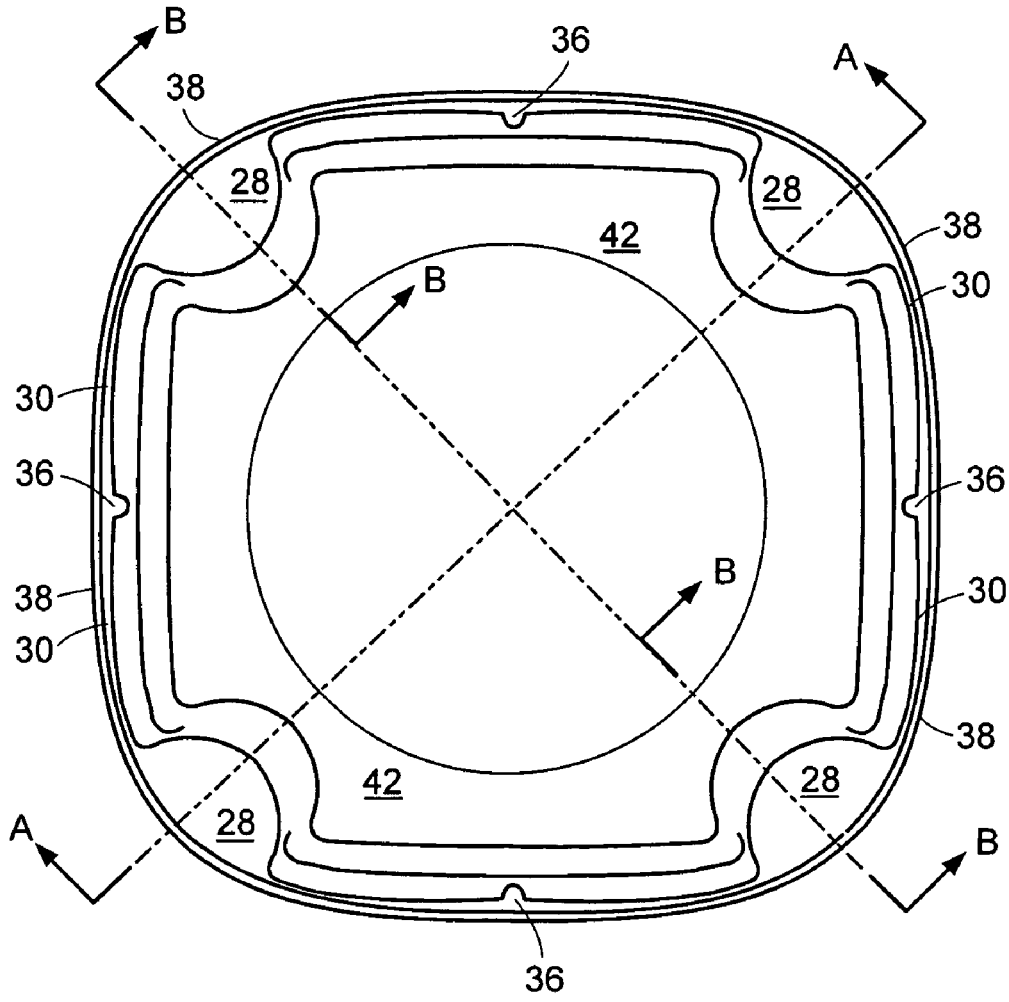
FIG. 4 is a top plan view of an embodiment of the invention.

The top rim 30 of the illustrated containers, shown from a top view in FIG. 4, has several features that improve stackability among containers. It is identical to the top rim 30 of other containers, regardless of the container volume. The common top rim design, and the commonly angled body allows the container volume to be altered by only changing the height of a particular container and the footprint of the container base, while maintaining other design features constant.

Figure 4A:
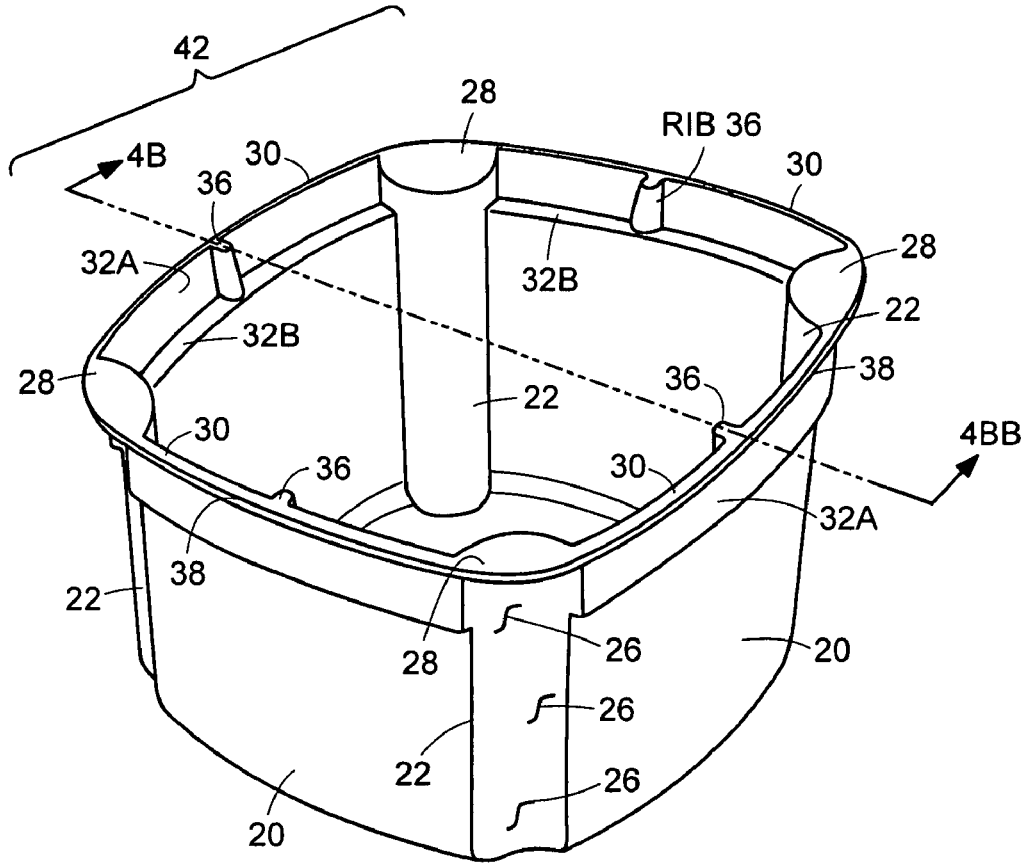
FIG. 4A is a perspective view of the embodiment of FIG. 4.

Extending downwardly from each top rim 30 and the stepped section 32 are four engagement ribs 36, equally spaced on the inside periphery as shown in FIG. 4A and adapted to contact the rim 30 of the nested container above.

In this arrangement, the stepped section 32 has an outer wall 32A coextensive with the periphery of the rim 30 and with the wall defined by lines near-parallel to the center axis of the container, but inclined in the order of 1° in molding direction, as is common in plastic injection molding practice.

Figure 4B:
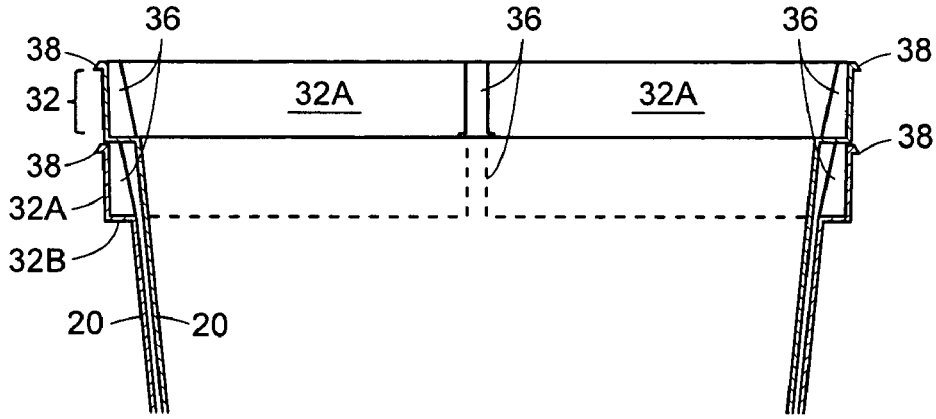
FIG. 4B is a fragmentary cross-sectional view of a pair of like nested containers taken along a line corresponding to the line 4B-4B of FIG. 4A.
Figure 6:
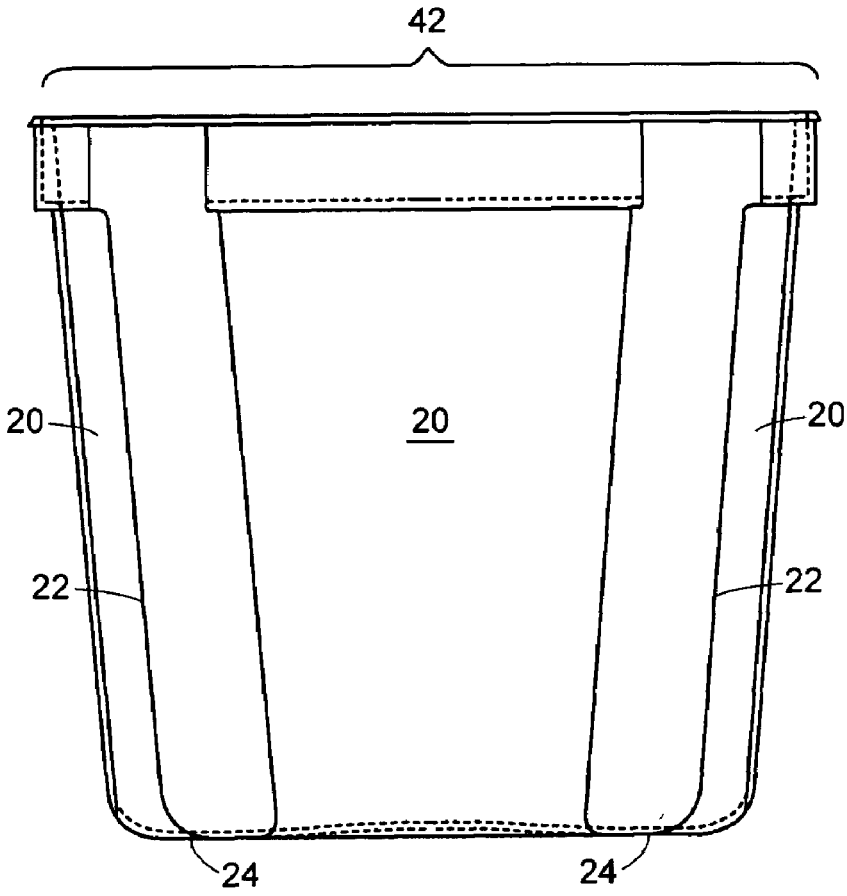
FIG. 6 is a partial cross-sectional view of an outer container and a full side view of a container nested within the outer container, taken along line 6B-6B shown in FIG. 4.
Figure 6A:
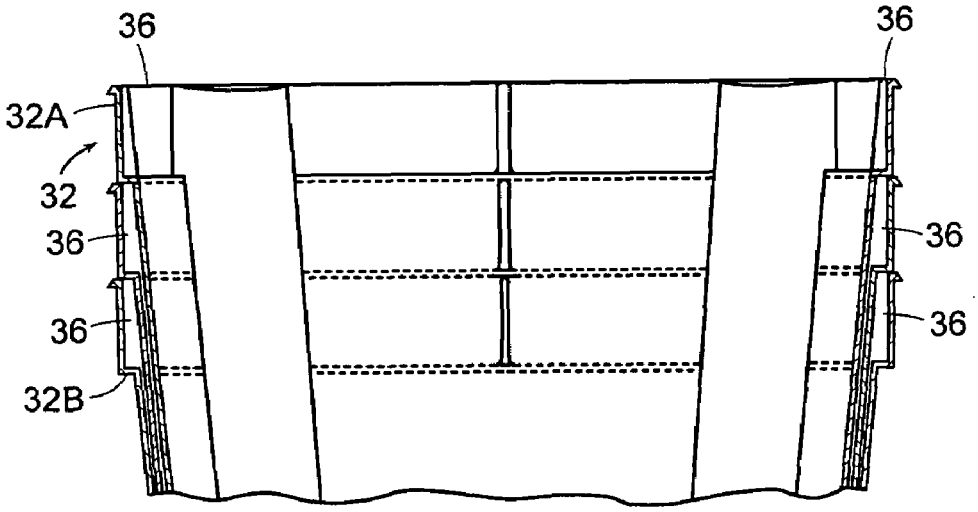

The bottom 32B of Section 32 connects the wall 32A and sidewall 20 (FIGS. 3, 4B and 6).

When stacked as shown in FIG. 4B, bottom 32B of one container mates only marginally with rim 30 of the stacked container immediately below, due to the thin (0.040) wall section and the 1° inclination (draft) of the stepped section 32 wall. This is shown in FIG. 6*a* where the underside or wall 32B of the stepped section 32 is in only marginal contact with the rim 30 of a nested container below (see also FIG. 4B).

In order to provide both a laterally definitive and vertically secure nesting/stacking arrangement, the four engagement ribs 36 are dimensioned to make contact with the bottom 32B of Section 32. Although only one rib 36 is shown, centrally located on each side, more than one rib may be selectively placed. To further illustrate this nesting/stacking system, FIGS. 4A and 4B (cross-section) are provided.

Figure 5B:
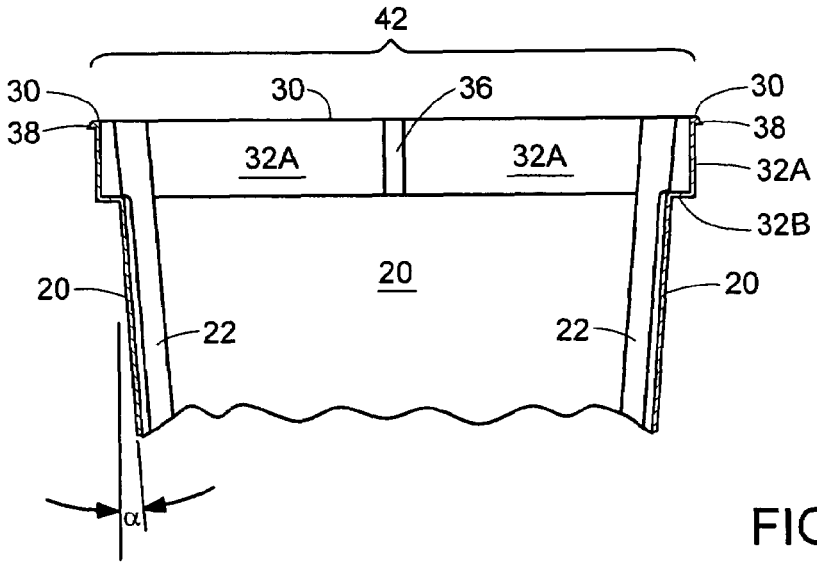

Each gripping groove or fluted section 22 terminates at the lip or wall 28 that is coextensive with the upper end of each container and in part defines the periphery of the annular top rim 30 (FIGS. 2 and 3). When the containers are stacked, these lips or walls 28 define a surface that a user can flex with a finger or thumb to pry nested containers apart, should that become necessary. This will not generally be necessary as the preferred container embodiments have 0.025 inches of clearance between the walls of mating containers. Additionally, the lips or walls 28 will ordinarily lie in facing relation with a lid secured on the container. FIG. 5 shows that when a lid is so secured the lip or wall 28 may be flexed with a finger or thumb together with the lid-rim 38 to pop the lid downward protruding lid-rim and lid from the container.

The common top rim 30 of each of the containers, regardless of their size and volume, also allows a common lid design to be used for all of the various containers. For instance, FIG. 2 shows one lid placed on top of a one pint container; however, the same lid may also be on a two quart container, a one quart container or any other container having a common top rim as the invention is not limited in this respect. Such common lids may also be placed closely next to one another to take up a minimum amount of storage space when stored alongside the stacked container columns. These lids may be stored within "lid pockets" 39 on the periphery of a turn and slide out unit that holds both the containers and lids such as illustrated and disclosed in issued U.S. Pat. No. 6,585,119, issued Jul. 1, 2003. The lids 18 are preferably made having matching radii at their corners and along their sides to conform to the preferred shape of the container top rim 30.

Some lids, according to the present invention, are made of a soft plastic material, such as polyethylene, that allows them to be stretched over the top rim of a container, thereby providing a snap-fit as illustrated in FIG. 5. Such a snap-fit provides the seal between the lid and the container, thereby further preventing leakage of any contents and/or spoilage of any contents inside the container. Generally, such snap-fit arrangements require that the entire outer edge of the top rim be bowed outwardly at all points to conform to the similarly shaped top edge of a container, as shown in FIGS. 4 and 5. Otherwise, if large portions of the top rim and lid were bowed inwardly, the pressure between the lid and the top rim may be reduced at the inwardly bowed portion such that a leak path could be formed. For these reasons, the top rim of the containers and lids of the present invention are generally bowed outward at all points.

The top rim of containers of the present invention, as shown in FIGS. 4, 5, and 6 also have a rim protrusion that helps provide the snap-fit and also improves the sealing capabilities of the container. The rim protrusion mates with a corresponding inner surface protrusion on the lid, as shown by the lid cross section in FIG. 5, to provide a noticeable 'snap' that is felt when the lid is secured in its locked position. If such a snap is not felt, the user is alerted that the lid may not be properly in place. The rim protrusion preferably comprises a 30 degree angled surface 38 at its upper edge that creates an interference fit with a corresponding overlapping surface on the inner portion 40 of the rim of a lid 18.

The containers of the present invention are also easy to handle when they are used. Each of the containers, regardless of size, include an inwardly extending flute or gripping groove 22 arranged in between each of the four sidewalls 20. This gripping groove 22 flared or is bowed inwardly relative to the sidewalls 20. However, the gripping grooves are also preferably angled outwardly in a direction from the bottom portion 24 of a container to the open end 42 to allow for stacking. For the preferred container, which is sized to have sidewalls spaced from one another by 5.55 inches at the top rim 30, the gripping grooves 22 are bowed inwardly along a suitable radius and the sidewalls are bowed outwardly with an equally suitable radius. For containers having top rims with different sizes, the gripping grooves and the sidewalls may be increased or decreased proportionally. One typical size contemplates the gripping grooves having a 0.5" radius and the sidewalls having a 10 inch radius, although other proportions are possible as the invention is not limited in this respect. The grooves or flutes 22 provide the user with a firm surface to grip and to apply pressure against with their thumb and fingers. The grooves provide this benefit when the containers are picked up by their bottom portion, as shown by the hand illustrated in FIG. 1, or when handled in other manners, such as when heavy contents are being poured from the container.

The gripping grooves also have features that prevent the container from slipping from a user's grasp. Some embodiments of the invention have a textured surface 26 as a part of the gripping grooves to enhance the grip offered to a user. For instance, the textured surface as shown in FIGS. 1, 2 and 6 enhances the amount of friction between the user and the container thus preventing any slippage of the container from the user's hand. In the preferred embodiment, this texture is integrally formed acid etched into the mold within the container gripping grooves and extends into the material to a maximum depth in accordance with best injection molding practices. Such texturing surface may be a part of the material that forms the body of the container, or it may be provided by an adhesive or a film that is applied to the container after it has been formed, as the invention is not limited in this respect.

The inwardly bowed gripping grooves 22 of the container improve the rigidity of the container structure. Many containers, particularly large, thin-walled containers have a tendency to bow or flex when gripped by a user. Such flexing allows the walls of a container to give way when grasped by a user, making the container difficult to hold and also potentially causing spillage. The inwardly bowed grooves, as shown in embodiments of the present invention, arranged in between the outwardly bowed sidewalls, held to prevent the structure from bowing inwardly at each of the corners of its essentially square construction. They also held to prevent the outwardly bowed sidewalls from flexing to a certain extent. More importantly, they provide a firm gripping surface that obviates the need for a user to grab a container by its larger sidewalls, which are more prone to flexing and the associated gripping problems. In some embodiments, the gripping grooves, or portions thereof, can have thicker walls to further improve container rigidity.

Generally the containers of the present invention are adapted to store most any contents that a user desires. However, the containers are particularly adapted for the storage of foodstuffs. For instance, food items that are regularly purchased for use in the house or a restaurant may be supplied in packages that are too large for normal every day use, or that are difficult to reseal once opened. It is often convenient to store such items in smaller or more easily sealable containers, like the containers described herein. The essentially square configuration also allows the containers to be packed amongst other storage containers in an efficient manner, as most other storage containers are also rectangular or square in design. Additionally, the containers are particularly suited to storing meals, either before they have been served or as leftovers to be saved for consumption at a later date as people generally like to view the contents of foodstuff contained at a glance, without opening them. To this end, the containers are preferably conventionally made of a clear plastic, such as ABS or polypropylene with wall thicknesses on the order of 0.040 to 0.050 inches, with highly polished surfaces to allow one to see the contents of the container through its sidewalls.

Figure 7A:
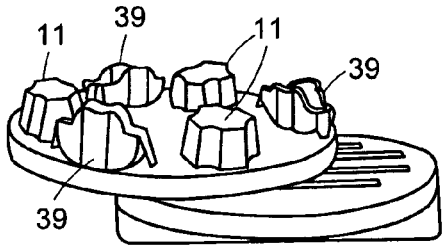
FIG. 7A is a perspective view of the same slide and turn base, showing lid pockets and positioning mandrels snapped in place on the turntable surface.
Figure 7:
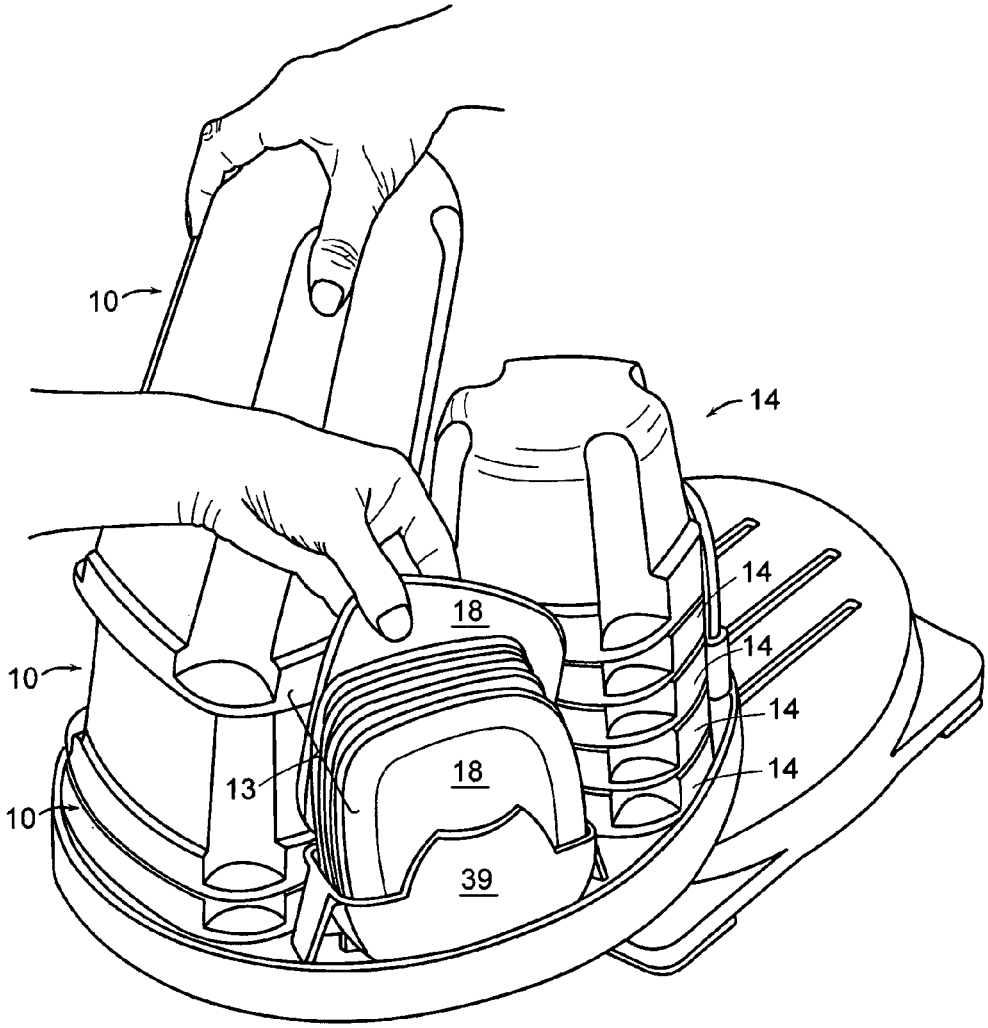
FIG. 7 is a perspective view of embodiments of the invention used on a slide-out and turn base, disclosed in U.S. Pat. No. 6,585,119 with lid pockets and rounded-square containers.

The containers may be adapted to fit within a slide out tray having a base with receptacles designed specifically to accept the top rim 30, the bottom 24, or any other portions of the various nestable containers. For instance, a slidable tray like that disclosed in U.S. Pat. No. 6,585,119, which is hereby incorporated in its entirety into the present application, maybe adapted for use with the nestable containers (FIG. 7). In particular, such a tray having a 11.75 to 12 inch diameter can accept three stacks of essentially square containers of the same or different sizes at positions 120 degrees apart from one another on the tray.

The periphery of this tray can also have 3 each distinct "lid-pockets" 39 for accepting three stacks 13 of container lids 18. The lid pockets accept those lids in a vertically placed staggered configuration. The stacked container open ends 42 are facing down onto the tray and are positioned by upwardly extending mandrils 11 (FIG. 7*a*). Such a configuration prevents loose debris and contaminants from falling inside of the containers 10 and 14 that may otherwise contaminate contents placed inside of them. In this manner, the tray with 3 each mandrils 11 provides additional benefits of keeping the containers in a sanitary condition and stable position.

As previously noted, one embodiment of this invention contemplates a container having a frusto conic shape, as shown at 15 and 17, in FIG. 1. These containers are similar in structure, design and function as containers 10 and 14 except for the use of a frusto conic sidewall 20A instead of four sidewalls 20 in the embodiments of containers 10 and 14. The cover 18A is designed to snap fit over the circular rim 30 of containers 15 and 17.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

This invention is not limited in its application to the details of construction and the arrangement of components set forth in the above description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items.

What is claimed is:

1. A nestable container having four sidewalls flared upwardly and outwardly from a common bottom with each sidewall connected to adjacent sidewalls by an inwardly fluted web extending over a majority of the height of the sidewall from the common bottom and defining thumb and finger gripping corners at the edges of said sidewalls.

2. A nestable container as set forth in claim 1, wherein an upper end of each fluted web has an upper edge that is continuous with upper edges of the adjacent sidewalls and defines a continuous edge for engagement with a lid.

3. A nestable container as set forth in claim 2, wherein the nestable container is adapted to nest with a second nestable container having an upper edge shaped substantially similar to the upper edge of the nestable container, the second nestable container defining an internal volume different than that of the nestable container.

4. A nestable container as set forth in claim 3, wherein the nestable container and the second nestable container have internal volumes selected from a group consisting of: 2 quart, 1 quart, and 1 pint.

5. A nestable container as set forth in claim 3, in combination with the lid, the lid adapted to fit both the nestable container and the second nestable container.

6. A nestable container as set forth in claim 4, wherein the sidewalls are arranged essentially at 90° to each adjacent sidewall.

7. A nestable container as set forth in claim 1, wherein an open end of the nestable container is defined by an upper edge adapted to mate with a lid, the upper edge being bowed outwardly at all points.

8. A nestable container as set forth in claim 7, in combination with the lid.

9. A combination as set forth in claim 8, wherein the lid is made of a soft plastic material and is adapted to stretch around the upper edge of the container for mating with the container.

10. A combination as set forth in claim 9, wherein the lid and the upper edge are defined by a substantially 10 inch radius along points adjacent to each sidewall and a substantially 1.6 inch radius along points adjacent to each fluted web.

11. A combination as set forth in claim 9, wherein the inwardly fluted web provides access to an underside of a protruding rim of the lid for facilitating removal of the lid from the container.

12. A combination as set forth in claim 11, wherein the upper edge of the container comprises an outwardly facing rim for securing the lid to the container.

13. A nestable container as set forth in claim 1 having a nonflared stepped section at an upper end of the sidewalls with the nonflared stepped section defined at least in part by lines substantially parallel to a center longitudinal axis of the container.

14. A nestable container as set forth in claim 13 wherein the sidewalls are outwardly bowed.

15. A nestable container as set forth in claim 1 having a stepped section contiguous with the sidewalls and defined by lines substantially parallel to a center axis of the container.

16. A nestable container as set forth in claim 14 wherein said stepped section defines a continuous wall about the top of the container and a plurality of ribs extending upwardly on the inner surface of said continuous wall to provide an interfering fit that limits nesting of another like container.

17. A nestable container having a frusto conic shaped sidewall with inwardly fluted webs extending over a majority of the height of the sidewall and defining thumb and finger gripping area for hand engagement with the container, wherein the inwardly fluted webs include a roughened textured surface to prevent the container from slipping out of a user's hand.

18. A nestable container as set forth in claim 17, wherein a pair of inwardly fluted webs are arranged diametrically opposite one another.

19. A nestable container as set forth in claim 18, wherein the container has a bottom connecting the sidewall, and a top lip, with the inwardly fluted webs extending downwardly from the lip toward the bottom.

20. A nested container as set forth in claim 19, wherein the lip extends over the upper end of the fluted webs.

21. A nested container as set forth in claim 20, wherein the frusto conic sidewall has segments essentially defining four sidewalls.

22. A nested container as set forth in claim 21, having four inwardly fluted webs orthogonally arranged to one another.

23. A nested container having a frusto conic shaped sidewall, a plurality of inwardly fluted webs extending parallel to one another between ends of said sidewall and terminating at one end of the open end of the container, with a peripheral lip at the open end extending outwardly, a stepped section adjacent the peripheral lip, and a plurality of engagement ribs extending downwardly from the peripheral lip towards the stepped section.

24. A nestable container comprising:

a frusto conic shaped sidewall;

a plurality of inwardly fluted webs defining thumb and finger gripping areas along the sidewall;

wherein the inwardly fluted webs extend substantially along the length of the sidewall from a closed end to an open end, and wherein the fluted webs have a substantially uniform radius of curvature; and wherein the inwardly fluted webs include a roughened textured surface to prevent the container from slipping out of a user's hand.

25. A nestable container as set forth in claim 24, wherein the a textured surface is formed by at least one of acid etching into a mold, applying an adhesive, and applying a film.

26. A nestable container as set forth in claim 24, wherein the inwardly fluted webs have a radius of curvature of approximately 0.5 inches.

27. A nestable container as set forth in claim 1, wherein the sidewalls are substantially planar.

* * * * *